United States Patent [19]

Neff

[11] 4,123,815

[45] Nov. 7, 1978

[54] FIXED POINT ELASTOMERIC BRIDGE BEARING AND BRIDGE ASSEMBLY

[75] Inventor: Clarence H. Neff, Skokie, Ill.

[73] Assignee: Felt Products Mfg. Co., Skokie, Ill.

[21] Appl. No.: 574,008

[22] Filed: May 2, 1975

[51] Int. Cl.[2] ..... E01D 19/06

[52] U.S. Cl. ..... 14/16.1; 248/22; 308/238

[58] Field of Search ..... 14/16 B; 248/22, 23; 308/238, 2 A

[56] References Cited

U.S. PATENT DOCUMENTS

| | | | |
|---|---|---|---|
| 3,105,252 | 10/1963 | Milk | 14/16 B |
| 3,301,609 | 1/1967 | Palfreyman | 14/16 B |
| 3,349,418 | 10/1967 | Hein | 14/16 B |
| 3,390,854 | 7/1968 | Sherburne | 14/16 B X |
| 3,544,415 | 12/1970 | Price | 14/16 B X |
| 3,728,752 | 4/1973 | Andra | 14/16 B |
| 3,782,789 | 1/1974 | Koester | 14/16 B |
| 3,806,975 | 4/1974 | Fyfe | 14/16 B |

FOREIGN PATENT DOCUMENTS

| | | | |
|---|---|---|---|
| 399,512 | 3/1966 | Switzerland | 14/16 B |

*Primary Examiner*—Nile C. Byers, Jr.
*Attorney, Agent, or Firm*—Dressler, Goldsmith, Clement, Gordon & Shore, Ltd.

[57] ABSTRACT

A fixed point bridge bearing assembly having a generally U-shaped channel having a base and end walls extending upwardly from said base. A load plate is supported within said channel. The load plate has spaced parallel end edges confronting the end walls. The load plate extends vertically above the end walls. Each pair of end walls and end edges defines an elongate gap therebetween. An elastomeric, supporting bearing body, which preferably embeds at least one shim, is bonded to and positioned between the load plate and the base. The bearing body supports the load plate within the channel. An elastomeric bearing body is positioned in each gap and is bonded to the end wall and end edge. Those bodies compressively resist movement of the load plate toward the end walls, while permitting rotation of the load plate and an associated beam relative to the channel. When fixed in a bridge construction, the bearing assembly end walls are transversely oriented relative to the length of the load carrying member, the channel is secured to a bridge support and the load plate is fixed to a load carrying member.

17 Claims, 8 Drawing Figures

FIG. 1
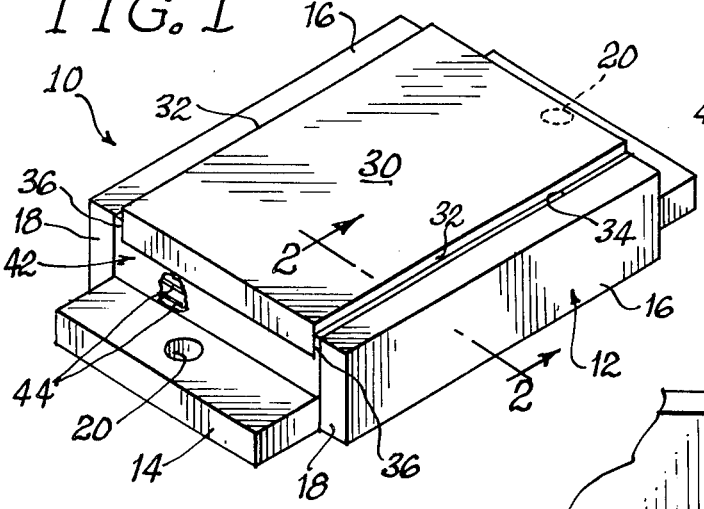
FIG. 2
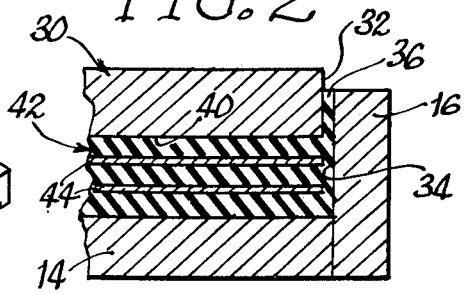
FIG. 3
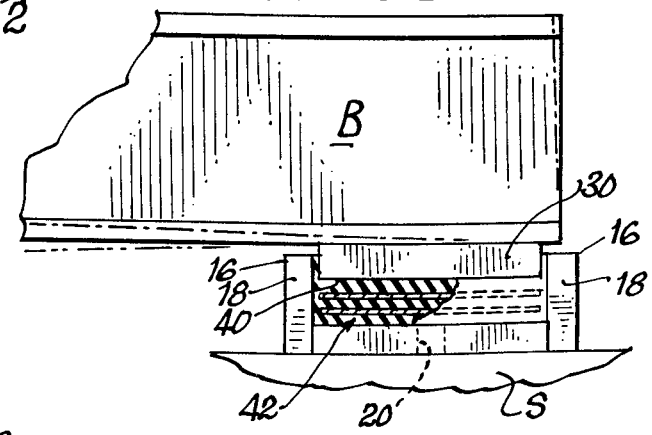
FIG. 4
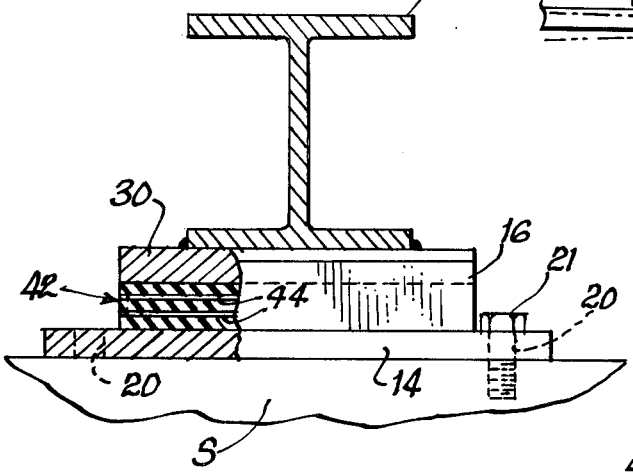
FIG. 5
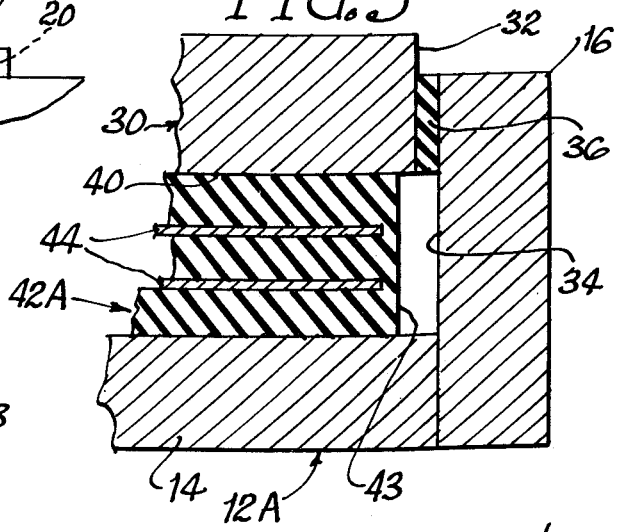
FIG. 6
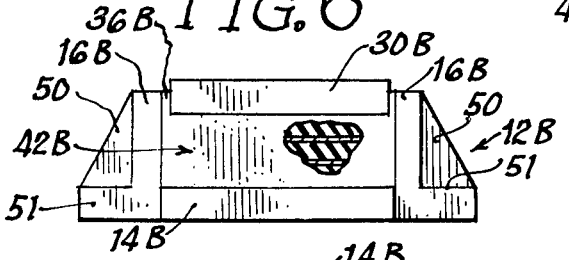
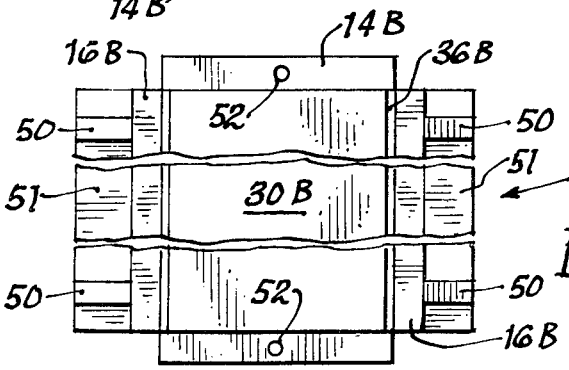
FIG. 7
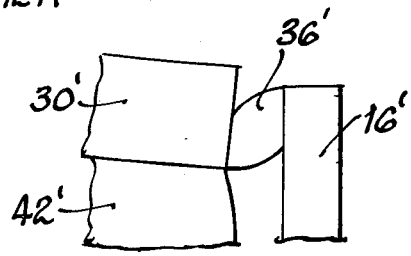
FIG. 8

FIXED POINT ELASTOMERIC BRIDGE BEARING AND BRIDGE ASSEMBLY

This invention relates to an improved bearing assembly for supporting a bridge at a fixed point, and more particularly to an elastomeric bearing assembly especially adapted for use at a fixed bearing point in a bridge assembly.

A wide variety of bridge bearings have been designed and are in use in bridge constructions. Some of these are especially configured to permit bridge movement relative to a fixed support. Others are primarily intended for use at a point at which a bridge is effectively anchored to a support, i.e., at a point at which longitudinal bridge movement is to be prevented. It is with bridge bearings of the latter type with which this invention is concerned.

A variety of bearing constructions have been developed for use at fixed bearing points. Most of these are mechanical bearings. Others are elastomeric pads or laminates which respond to the compressive loads applied, which are intended to accommodate limited beam rotation, but which are constructed to restrain and prevent both longitudinal and lateral movements of a bridge relative to a bridge support. In some cases, pins or bolts set in, or fixed to the bridge support and/or the bridge itself are provided and extend through holes in the bearing to prevent such movement. However, when substantial longitudinal or other horizontal force components are encountered, such as those due to the longitudinal slope of a bridge, or due to substantial braking and wind forces or the like, excessive force on such pins or bolts, and particularly on their unsupported ends, may tend to bend and break them. Further, in such constructions, if it becomes necessary to remove or replace a bearing, the entire bridge must be elevated to allow such pins to clear the associated bearing. Because of the loads, weights and bulk involved in bridges, at times it becomes virtually impossible to accomplish that.

This invention provides an improved fixed bearing construction for use in a bridge construction which obviates many of the problems and disadvantages of prior art fixed bearing assemblies. A bridge bearing assembly in accordance with this invention comprises a trough having a base and end wall means extending upwardly from said base. A load plate is supported within said trough and has end edge means which are spaced from, and which confront the end wall means. The load plate extends vertically above the end wall means. The end wall means and the end edge means define an elongate gap therebetween. An elastomeric supporting bearing body, which preferably embeds at least one shim, is positioned between the load plate and the base. The bearing body serves to support the load plate within the trough and the bearing body is preferably bonded both to the load plate and to the base.

Elastomeric bearing body means are provided for filling the gap, compressively to resist movement of the load plate toward the end wall means while permitting rotation of the load plate and associated beam relative to the trough. The elastomeric gap filling body means are bonded to the end wall means and to the load plate end edge means.

Preferably the trough is a generally U-shaped channel and the end wall means comprise a pair of spaced end walls, while the end edge means comprises a pair of parallel spaced end edges. Each pair of confronting end walls and end edges defines a gap therebetween which is filled with a gap filling elastomeric bearing body bonded to each. These bodies are preferably of substantially uniform dimension along their respective lengths.

The elastomeric supporting bearing body may be bonded to the end walls or its sides may be spaced inwardly of the end walls. Reinforcing means for supporting the end walls against outward collapse may also be provided.

When fixed in a bridge construction at a fixed bearing point between a load carrying member and a bridge support, the bearing assembly end walls are transversely oriented relative to the length of the load carrying member, the trough is secured to the bridge support and the load plate is fixed to the load carrying member. Accordingly, the bearing assembly is positioned so that if the load carrying member is stressed longitudinally a gap filling elastomeric body will compressively resist longitudinal movement of the load carrying member.

These and other objects, features and advantages of the fixed point bearing assembly of this invention will become apparent from the following description and drawings of which:

FIG. 1 is a perspective view of a fixed point bridge bearing assembly of this invention;

FIG. 2 is a fragmentary cross-sectional view of the bearing assembly of FIG. 1, taken substantially along line 2—2 of FIG. 1;

FIG. 3 is a side elevational view of a bearing assembly of FIG. 1 interposed between a bridge beam and bridge support;

FIG. 4 is an end view of a bearing assembly of FIG. 1, partially broken away, interposed between a bridge beam and a bridge support;

FIG. 5 is an enlarged view, similar to FIG. 2, of a further embodiment of this invention;

FIG. 6 is a side elevational view, similar to FIG. 3, of a further embodiment of a bridge bearing assembly of this invention;

FIG. 7 is a plan view of the bearing assembly of FIG. 6; and

FIG. 8 is an exaggerated schematic view of a bearing pad assembly of this invention under load.

Referring now to the drawings, a bridge bearing pad assembly 10 according to this invention includes a trough or channel assembly 12 which may be a unitary casting or which may be formed from several plates. In the embodiment of FIG. 1 channel assembly 12 has a base member or plate 14 and generally parallel end walls or end plates 16. End plates 16 are suitably secured, as by welding, to plate 14 at the edges of plate 14 to define a channel assembly which is generally U-shaped in transverse cross-section. Preferably base plate 14 extends beyond the side edges 18 of plates 16 and provides mounting holes 20 by which the channel assembly 12 may be mounted to a bridge support such as a pier or the like.

A floating load plate or sole plate 30 which is generally rectangular in plan view is provided. It is embedded in an elastomer which limits and restricts its freedom of movement. As seen in FIGS. 1 and 2, the parallel end edges 32 of floating load plate 30 are spaced from the inner surfaces 34 of end plates 16 to define elongate gaps, each of which is of substantially uniform dimension along the lengths of the gaps. The gaps are filled by elastomeric bearing bodies 36 which are of a substantially uniform dimension along their lengths. Beneath the lower surface 40 of floating load plate 30, an elastomeric supporting bearing body 42 is provided. Supporting body 42 comprises an elastomeric bearing pad, which may have one or more shims 44 which serve to strengthen body 42 and to increase its effective rubber thickness. Under compression, because they are confined at two edges, the elastomeric bodies exhibit great strength.

When assembly 10 is to be readied for use, the load plate 30 is secured, as by welding, to a load carrying member such as to the flange of a bridge beam B. It is possible also to secure load plate 30 to the load carrying member by bolts which pass through the bridge beam flange into suitably tapped openings in load plate 30. Base plate 14 is fixedly secured to a pier or other bridge support S in the orientation illustrated by FIG. 3, as by bolts 21 (see FIG. 4). In that manner bearing pad assembly 10 is fixed in position relative to both the bridge beam and bridge support, and relative longitudinal and lateral movement of the beam with respect to the support will be restrained.

Movement of the beam B lengthwise relative to the bridge support S to which the bearing assembly 10 is secured is compressively restrained and limited by end plates 16 and by the interposed elastomeric bearing bodies 36. However, very slight lateral movement of the beam relative to support S is permitted under unusual stress conditions because the sides of the channel assembly 12 are open and because the supporting body 42 may therefore move in shear. This possibility of lateral movement is quite important because it relieves any locked-in lateral stresses which result from temperature changes. Stresses due to temperature variations can be quite substantial in wide bridges and are therefore a factor which must be considered in bridge design. It is also to be noted, as shown by FIG. 3, that limited beam rotation is accommodated by the bearing pad assembly 10 of this invention.

In the embodiment of FIG. 5, a channel assembly 12 having a base plate 14 and end walls 16 is provided with an elastomeric supporting bearing body 42A, the sides 43 of which are spaced away from end plates 16. In this embodiment, when the supporting body 42A is under compression, the sides 43 remain spaced from end plates 16. Therefore, the only loads transmitted to the end plates 16 are those transmitted through the bearing bodies 36 when the beam and load plate tend to move longitudinally, such as those due to braking forces, those resulting from the incline of the bridge, etc. As such, the end plates 16 need not be sufficiently strong to take up the loads due to compression of the body 42A as well.

Although end plates 16 may need no support, in some cases the forces against them may be so great that the plate thickness necessary to resist distortion may become excessive. In such cases, or where otherwise desired, reinforcing support may be provided. Such a configuration is illustrated by FIGS. 6 and 7 where a channel assembly 12B is seen to comprise end plates or walls 16B and a base plate 14B which extends outwardly beyond the end walls. End walls 16B may be integrally formed, with plate 14B, as by being cast of malleable iron. To provide additional strength against longitudinal collapse, integral reinforcing means such as struts 50 are provided. In the embodiment of FIGS. 6 and 7, a pair of spaced struts 50 which extend downwardly and outwardly from the end walls 16B and which merge with the outward extensions 51 of the base plate is provided for each end wall 16B. Suitable bolt holes 52 are provided in the base plate 14B for securing the bearing assembly 10B to a bridge support. The load plate 30B, bodies 36B and rubber body 42B may otherwise be the same as those of the embodiments of FIGS. 1 to 4 and 5.

It will be noted that the channels illustrated are open at their ends. Where substantial lateral beam movement is anticipated or is to be designed for, structural limiting members should be added to make certain that shear destructive strain of the bearing will not be permitted in a lateral direction.

In the bearings disclosed, the elastomer and shims are encased and bonded in the channel in a direction transverse to the length of the bridge beam. The shims are completely encapsulated.

As is clear from the drawings, the elongate gaps between the load plate and the channel end walls are filled with elastomeric bodies which are bonded to, and preferably vulcanized with, both the load plate end edges and the inner surfaces of the channel end plates. Accordingly, any attempted movement of the bridge beam longitudinally places the elastomeric bodies in compression on one side and in tension on the other. As such, the bearing assemblies of this invention have portions which function to resist movement of the bridge beam longitudinally in compression, and portions which compressively resist vertical movement of the bridge in response to live and dead loads.

Fixed elastomeric bearings in accordance with this invention may vary with the loads and forces which are anticipated. The plan view dimensions of a typical bearing assembly made according to this invention was 12 inches long (in the direction transverse to the length of the beam) and was ten and one-half inches wide (in the direction of the length of the beam). The end walls and base plate were three-quarter inch thick and elastomer completely filled the space between the inner surfaces 34. Bearing bodies 36 extended to the upper surfaces of the end walls 16. Supporting body 42 had three layers of elastomer, each of which was seven-sixteenths inch in height, and had two, one-sixteenths inch shims spaced equidistantly below the load plate. The shims were embedded in the elastomer and extended to within about one-quarter inch of each of the lateral surfaces of the body 42. The load plate was about 1½ inches thick, about 8½ inches wide and about 12 inches long and was positioned in the elastomer as illustrated by FIG. 1. It extended above the upper surfaces of the end walls 16 by approximately one-half inch. The bearing bodies 36 and 42 were vulcanized and bonded both to the load plate and to inner surfaces 34, as well as to the base plate 14. The elastomer used for body 42 and bodies 36 was chloroprene having a hardness of about 50 durometer according to ASTM test D676. The bearing effectively and compressively resisted simulated movements of a bridge beam longitudinally, resisted excessive uplift, while permitting restraint-free rotation of the bridge beam, within design limits, at a fixed bearing point.

The design of fixed elastomer bearings of this invention depends both upon design factors and criteria and practical considerations such as space availability, and the like. Within the limits of the design criteria and the limits imposed and factors of safety required by the responsible engineers or architects for a given bridge, the limits of the strengths of the materials available for use in constructing the bearing will also play a part in arriving at a bearing construction which will satisfy all of the necessary requirements. Bearings according to this invention may be made in various sizes and shapes and for a particular set of design criteria may be of different sizes and dimensions. We shall now refer to some of the design considerations.

It will be apparent that the nature of the bearings of this invention are such that the movement and responses of the several bearing portions affect each other. Accordingly, although the anticipated movement of each portion, and the loads which each is designed to accommodate can separately be calculated, ultimately the specific and optimum dimensions for a particular application must be arrived at empirically, and as a function of the design criteria of the particular bridge designer, the incline of the beam, the live and dead load reactions, the particular elastomers to be used, the space limitations for the bearings, and many others.

With respect to the supporting elastomeric bodies 42, 42A and 42B, usual design criteria applied to the design of elastomeric bearings may be utilized in arriving at a suitable supporting body. With respect to bearing bodies 36, it is clear that they must resist compressive loads when a bridge beam tends to move longitudinally under braking forces, due to beam inclination and the like. It is also clear that because they are bonded to the load plate and to the end walls 34, when compressive loads transmitted through the load plate to the supporting bodies are applied, the load plate will move downwardly and will act on the bodies 36 in shear. As such, the bearing bodies must be designed adequately to accommodate both compressive loads in a generally horizontal plane and vertical shear stresses to which they are subjected. FIG. 8 illustrates a typical bearing body 36 in relation to a load plate and end wall, and the shape which it might assume under the compound loading to which it is subjected. FIG. 8 is exaggerated for illustrative purposes.

Accordingly, bearing bodies 36 are designed so that they will not be excessively strained and so that they will not excessively bulge.

In accordance with current bridge design practice, it is preferred that the thickness of the elastomeric bodies (in the direction of the width of the gap) be at least twice the amount the bodies will be deflected in shear, i.e., at least twice the distance the load plate 30 will move downwardly under maximum anticipated loading. It may be however, that greater strain will be permissible in some environments. The elastomeric bodies should also be designed with a proper shape factor so that under compressive loading they will not bulge to the point of rupture or failure. In connection with this, normal calculations applied to bearings are not entirely operative, because when one body 36 is under compression, the other is in tension. This phenomenon makes it possible to use a body 36 which is somewhat undersized for the compressive load to be resisted relative to what would be necessary if there were no counterbalancing tensile force.

These and other modifications within the scope and purview of this invention will become apparent from the preceding description and drawings. Accordingly, I intend the scope of this invention to be limited only in accordance with the claims.

What is claimed is:

1. A bridge bearing assembly comprising a trough having a base and end wall means extending upwardly from said base, a load plate supported within said trough and having end edge means spaced from and confronting said end wall means, said load plate extending vertically above said end wall means, said end wall means and said end edge means defining an elongate gap therebetween, an elastomeric supporting bearing body positioned between said load plate and said base and supporting said load plate within said trough, said bearing body being bonded to said load plate and to said base, said trough defining laterally open sides between said end wall means for accommodating lateral shear movement of said elastomeric supporting bearing body, and elastomeric bearing body means bonded to said end wall means and to said load plate end edge means and filling said gap compressively to resist movement of said load plate toward said end wall means.

2. A bridge bearing assembly in accordance with claim 1 in which said trough is a channel which is generally U-shaped in transverse cross-section, and wherein said end wall means comprises a pair of spaced end walls, and said end edge means comprises a pair of spaced end edges, each pair of said confronting end walls and end edges defining a gap therebetween, and wherein said elastomeric bearing body means comprises an elastomeric bearing body in each said gap and bonded to its confronting end wall and end edge.

3. A bridge bearing assembly in accordance with claim 2 in which said elastomeric supporting bearing body extends to said end walls and is bonded to each of said end walls.

4. A bridge bearing assembly in accordance with claim 2 in which said elastomeric supporting bearing body has sides which are spaced away from said end walls.

5. A bridge bearing assembly in accordance with claim 2 in which said base extends outwardly beyond said end walls, and further comprising reinforcing means extending downwardly and outwardly fron the said walls and merging with said base.

6. A bridge bearing assembly in accordance with claim 2 in which said elastomeric supporting bearing body embeds at least one shim positioned between said base and said load plate.

7. A bridge bearing assembly in accordance with claim 2 in which each of the elastomeric bearing bodies in the gaps is of a substantially uniform dimension along its length.

8. A bridge bearing assembly comprising a channel comprising a base and a pair of spaced parallel end walls extending upwardly from said base, a load plate supported within said channel and having a pair of spaced parallel end edges, one of said pair of end edges confronting each of said end walls to define an elongate gap therebetween, said load plate extending upwardly above the end walls, an elastomeric supporting bearing means positioned between said load plate and said base and supporting said load plate within said channel, said supporting bearing means being bonded to each of said load plate and said base, an elastomeric bearing body in each of said gaps and confronting said end walls and end edges and filling said gap, each said body being proportioned compressively to resist movement of said load plate toward its associated end wall, and said channel defining laterally open sides between said pair of parallel spaced end walls for accommodating lateral shear movement of said elastomeric supporting bearing means.

9. A bridge bearing assembly in accordance with claim 8 in which said elastomeric supporting bearing means extends to said end walls and is bonded to each of said end walls.

10. A bridge bearing assembly in accordance with claim 8 in which said elastomeric supporting bearing means has sides which are spaced away from said end walls.

11. A bridge construction at a fixed bearing point comprising a load carrying member and a bridge support, and a fixed bridge bearing assembly for compressively resisting relative movement longitudinally of the bridge construction while accommodating rotation of said load carrying member relative to the bridge support, said bearing assembly comprising a transversely oriented trough having a base and end wall means extending upwardly from the base, means securing said trough to said bridge support, a load plate fixed to said load carrying member and supported within said trough between said end wall means, said load plate extending vertically above said end wall means and having end edge means spaced from but confronting said end wall means, said end wall means and said end edge means defining an elongate gap therebetween, an elastomeric supporting bearing body within said trough and positioned between said load plate and said base and supporting said load plate, said elastomeric supporting bearing body being in vertical compression and being bonded to said load plate and said base, said trough defining laterally open sides between said end wall means for accommodating lateral movement of said load carrying member relative to said bridge support, and elastomeric bearing body means bonded to said end wall means and to said end edge means and filling said gaps compressively to resist movement of said load plate toward and away from said end wall means, said bearing body means being deformed in shear.

12. A bridge construction in accordance with claim 11 in which said trough is a channel which is generally U-shaped in transverse cross-section, and wherein said wall means comprises a pair of spaced end walls, and said end edge means comprises a pair of spaced end edges, each pair of said confronting end walls and end edges defining a gap therebetween, and wherein said elastomeric body means comprises an elastomeric bearing body in said gap and bonded to a confronting end wall and end edge.

13. A bridge construction in accordance with claim 12 in which said elastomeric supporting bearing body extends to said end walls and is bonded to each of said end walls.

14. A bridge construction in accordance with claim 12 in which said elastomeric supporting bearing body has sides which are spaced away from said end walls.

15. A bridge construction in accordance with claim 12 in which said base extends outwardly beyond said end walls, and further comprising reinforcing means extending downwardly and outwardly from said end walls and merging with said base.

16. A bridge construction in accordance with claim 12 in which said elastomeric supporting bearing body embeds at least one shim positioned between said base and said load plate.

17. A bridge construction in accordance with claim 12 in which each of the elastomeric bearing bodies in the gaps is of a substantially uniform dimension along its length.

* * * * *